US008733443B2

(12) United States Patent
Al-Taq

(10) Patent No.: US 8,733,443 B2
(45) Date of Patent: May 27, 2014

(54) INDUCING FLOWBACK OF DAMAGING MUD-INDUCED MATERIALS AND DEBRIS TO IMPROVE ACID STIMULATION OF LONG HORIZONTAL INJECTION WELLS IN TIGHT CARBONATE FORMATIONS

(75) Inventor: Ali A. Al-Taq, Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 247 days.

(21) Appl. No.: 12/974,306

(22) Filed: Dec. 21, 2010

(65) Prior Publication Data

US 2012/0152551 A1 Jun. 21, 2012

(51) Int. Cl.
*E21B 43/16* (2006.01)
*E21B 43/25* (2006.01)

(52) U.S. Cl.
USPC ..... 166/307; 166/369; 166/372; 166/401

(58) Field of Classification Search
USPC ..... 166/369, 372, 307, 401
See application file for complete search history.

(56) References Cited

U.S. PATENT DOCUMENTS

| | | | | |
|---|---|---|---|---|
| 2,811,209 | A * | 10/1957 | Elkins | 166/302 |
| 3,902,523 | A * | 9/1975 | Gaut | 137/498 |
| 4,187,911 | A | 2/1980 | Hutchison et al. | |
| 4,630,679 | A | 12/1986 | Reeves et al. | |
| 5,203,413 | A | 4/1993 | Zerhboub | |
| 5,385,206 | A | 1/1995 | Thomas | |
| 5,655,605 | A | 8/1997 | Matthews | |
| 5,862,869 | A * | 1/1999 | Michael | 175/71 |
| 5,937,949 | A | 8/1999 | Lezzi et al. | |
| 6,131,661 | A * | 10/2000 | Conner et al. | 166/300 |
| 6,192,985 | B1 | 2/2001 | Hinkel et al. | |
| 6,250,389 | B1 | 6/2001 | Sudol | |
| 6,443,245 | B2 | 9/2002 | Michael | |
| 6,494,262 | B1 * | 12/2002 | Chitty | 166/311 |
| 6,527,050 | B1 | 3/2003 | Sask | |
| 6,719,054 | B2 | 4/2004 | Cheng et al. | |
| 6,722,438 | B2 * | 4/2004 | Sask | 166/312 |
| 6,968,898 | B2 | 11/2005 | Todd et al. | |
| 6,978,838 | B2 | 12/2005 | Parlar et al. | |
| 7,090,018 | B2 | 8/2006 | Livingstone | |
| 7,114,581 | B2 | 10/2006 | Aronstam et al. | |

(Continued)

FOREIGN PATENT DOCUMENTS

JP 2009114745 A 5/2009

OTHER PUBLICATIONS

International Search Report and Written Opinion mailed Mar. 28, 2012 by the International Search Authority in International Application No. PCT/US2011/061342 (6 pages).

*Primary Examiner* — Jennifer H Gay
(74) *Attorney, Agent, or Firm* — Abelman, Frayne & Schwab

(57) ABSTRACT

A method for treating an open-hole horizontal water injection well in a tight reservoir rock formation to remove undesirable materials such as formation-damaging polymers and chemical residues from pipe dope from the formation surface and adjacent formation pores prior to an acidizing treatment includes maintaining the drilling fluid pressure on the injection zone to induce flowback of formation fluid which is produced at the wellhead located at the earth's surface, where it is monitored for a reduction in the undesirable materials. In the event that the formation pressure is insufficient to produce formation fluid flowback, a nitrogen-lift is introduced at a predetermined location in the adjacent vertical well that will reduce the drilling fluid pressure to induce production of formation fluid at the wellhead.

9 Claims, 4 Drawing Sheets

(56) References Cited

U.S. PATENT DOCUMENTS

| | | | | |
|---|---|---|---|---|
| 7,514,390 | B2 * | 4/2009 | Chan | 507/202 |
| 7,514,391 | B2 * | 4/2009 | Chan | 507/202 |
| 7,618,924 | B2 | 11/2009 | Al-Yami | |
| 7,621,324 | B2 * | 11/2009 | Atencio | 166/250.15 |
| 7,703,529 | B2 | 4/2010 | Robinson et al. | |
| 7,712,536 | B2 * | 5/2010 | Pirolli et al. | 166/312 |
| 7,992,656 | B2 * | 8/2011 | Dusterhoft et al. | 175/72 |
| 2003/0141073 | A1 | 7/2003 | Kelley | |
| 2006/0137879 | A1 * | 6/2006 | Chan | 166/307 |
| 2007/0227722 | A1 * | 10/2007 | Atencio | 166/53 |
| 2008/0066910 | A1 | 3/2008 | Alary et al. | |
| 2009/0090158 | A1 | 4/2009 | Davidson et al. | |
| 2009/0126929 | A1 | 5/2009 | Vinegar | |
| 2009/0173501 | A1 | 7/2009 | Kotsonis et al. | |
| 2009/0321071 | A1 | 12/2009 | Zhang et al. | |
| 2010/0071904 | A1 * | 3/2010 | Burns et al. | 166/302 |
| 2010/0089462 | A1 * | 4/2010 | Atencio | 137/15.01 |
| 2012/0247785 | A1 * | 10/2012 | Schmitt | 166/372 |

* cited by examiner

INDUCING FLOWBACK OF DAMAGING MUD-INDUCED MATERIALS AND DEBRIS TO IMPROVE ACID STIMULATION OF LONG HORIZONTAL INJECTION WELLS IN TIGHT CARBONATE FORMATIONS

FIELD OF THE INVENTION

This invention relates to a method of conditioning a long horizontal open-hole water injection well in a tight formation prior to acid stimulation to improve the contact of the acid with the rock as well as the penetration of the acidic materials into the reservoir rock and thereby enhance the permeability of the formation and the flow rate of the injected water.

BACKGROUND OF THE INVENTION

It is a common practice to employ acid stimulation of low-permeability or damaged carbonate reservoir formations in order to enhance the flow and production of hydrocarbon fluids from the formation surrounding the wellbore. Acid treatment of water injection wells is similarly employed to enhance the permeability of the reservoir. However, the effectiveness of the acid treatment can be seriously reduced if the wellbore contains formation damage caused by incursions of drilling fluids, or mud, and other foreign matter. This problem is particularly pronounced in water injection wells through tight carbonate reservoir formations and results in acid treatments that are less successful than those carried out in relatively high permeability water injection wells.

The effectiveness of the acid treatment is directly proportional to the injection rate (e.g., barrels of water/minute) and inversely proportional to the injection pressure, i.e., a lower pressure is required for a given injection rate following an effective acid treatment.

It has been found that hydrochloric acid which can effectively dissolve the calcium carbonate minerals present in both the filter cake and the formation is not capable of dissolving or degrading some of the formation-damaging polymer components present in the drilling fluid, such as xanthan gum and starch. The xanthan gum is used to increase viscosity and the starch to control fluid loss. Three different damage mechanisms associated with drilling fluids are filtrate invasion, solid invasion (internal filtercake) and external filtercake. Other materials used in assembling the drilling pipe can also cause damage to the surrounding formation. Pipe dope applied to the couplings and other fittings used in assembling the drilling pipes and associated components can also cause damage to the surrounding formation.

As used herein, the term "undesirable materials" will be understood to refer to formation-damaging polymers, other chemical substances, debris and other materials which interfere with the flow of formation fluids from the walls and adjacent reservoir rock of the well bore and thereby reduce the productivity/injectivity of the well. The inherent formation pressure is the pressure of the fluids in the pores of a reservoir created by the weight of the overburden, water injection and any underground withdrawal.

As used herein, the term "wellbore" if not otherwise modified, will be understood to mean the combined vertical section and the open-hole horizontal section of the well.

It is therefore an object of the present invention to provide a method of substantially eliminating or greatly reducing the presence of formation-damaging materials, such as polymer components and pipe dope residue that interfere with the effectiveness of an acid stimulation treatment in an open-bore horizontal water injection well, to thereby render the subsequent acid treatment of the formation more efficient and effective.

SUMMARY OF THE INVENTION

The method of the present invention comprehends the inclusion of an additional step or pre-treatment stage prior to the introduction of the pressurized acid treatment of a water injection well in which the injection portion of the horizontal open-hole wellbore is subjected to flowback of the formation fluids for a period of time that is sufficient to remove a substantial portion of the undesired materials from the walls of the wellbore and from the adjacent formation. In some formations, the flowback stage can be achieved as a result of the inherent reservoir pressure and once the application of pressure on the drilling fluid is discontinued at the surface, the formation fluids will flow into the open-hole bore with sufficient force to displace the introduced wellbore fluids back up through the vertical wellbore and produce the formation fluids and the undesirable materials to the surface through the production/injection tubing.

The rate and time allowed for the flowback is controlled at the wellhead. In such a case, the flowback can be achieved by depressurizing the wellbore fluid to atmospheric and opening the wellhead valve to discharge the wellbore fluid.

The formation fluids produced during the flowback step can include brine, hydrocarbon liquids and/or gases and will initially include damaging mud-induced solids introduced under pressure into the wellbore during the drilling of the wellbore and the liquid that was forced into the pores of the reservoir rock. The portion of the reservoir occupied by solids faulted on the horizontal open-hole bore surface and the solids and liquid penetrating the formation around the bore are referred to herein as the infiltration zone.

In the event that the inherent reservoir pressure is not sufficient to raise the wellbore fluid, formation fluids, debris and undesirable materials to the wellhead at the earth's surface, the flowback is achieved by reducing the hydrostatic pressure of the completion fluid in the production zone to a pressure that is less than the inherent pressure of the formation fluids proximate to the production zone. The hydrostatic pressure of the fluid is reduced by displacing a portion of the fluid from the vertical section of the wellbore to the earth's surface.

In one preferred embodiment of this aspect of the method of the invention, the wellbore fluid is displaced by the use of a "nitrogen lift" process in which nitrogen gas is circulated through the production/injection conduit and into the wellbore to displace liquids and to thereby reduce the hydrostatic pressure created by the fluid column that extends to the wellhead at the earth's surface. Nitrogen lifting is well known and is a commonly used technique for initiating production in a well following acidizing treatments or over-balanced completions.

The quality of the completion fluid, debris and undesirable materials, along with any produced formation fluid(s) are monitored at the wellhead during the flowback stage. Samples of the formation fluids are subjected to periodic physical inspections. When the amount of undesirable materials is reduced to a predetermined acceptable level, the flowback stage is terminated.

Following termination of the flowback stage, the wellbore is prepared for the acidizing treatment stage in accordance with standard and customary procedures. This typically includes a preflush step which consists of water, a mutual solvent and water-borne wetting surfactant is next used to condition the wellbore for the acid treatment. The acidizing treatment stage of the process can include a 20% by weight emulsified HCl solution injected under pressure followed by a spacer of non-emulsified HCl and appropriate additives, which is then followed by a diverting agent.

BRIEF DESCRIPTIONS OF THE DRAWINGS

The invention will be described below in further detail and with reference to the attached drawings in which:

FIG. 1 schematically depicts a typical open-bore horizontal water injection well completion of the prior art in which the method of the invention can advantageously be practiced;

DETAILED DESCRIPTION OF INVENTION

Figure 1:
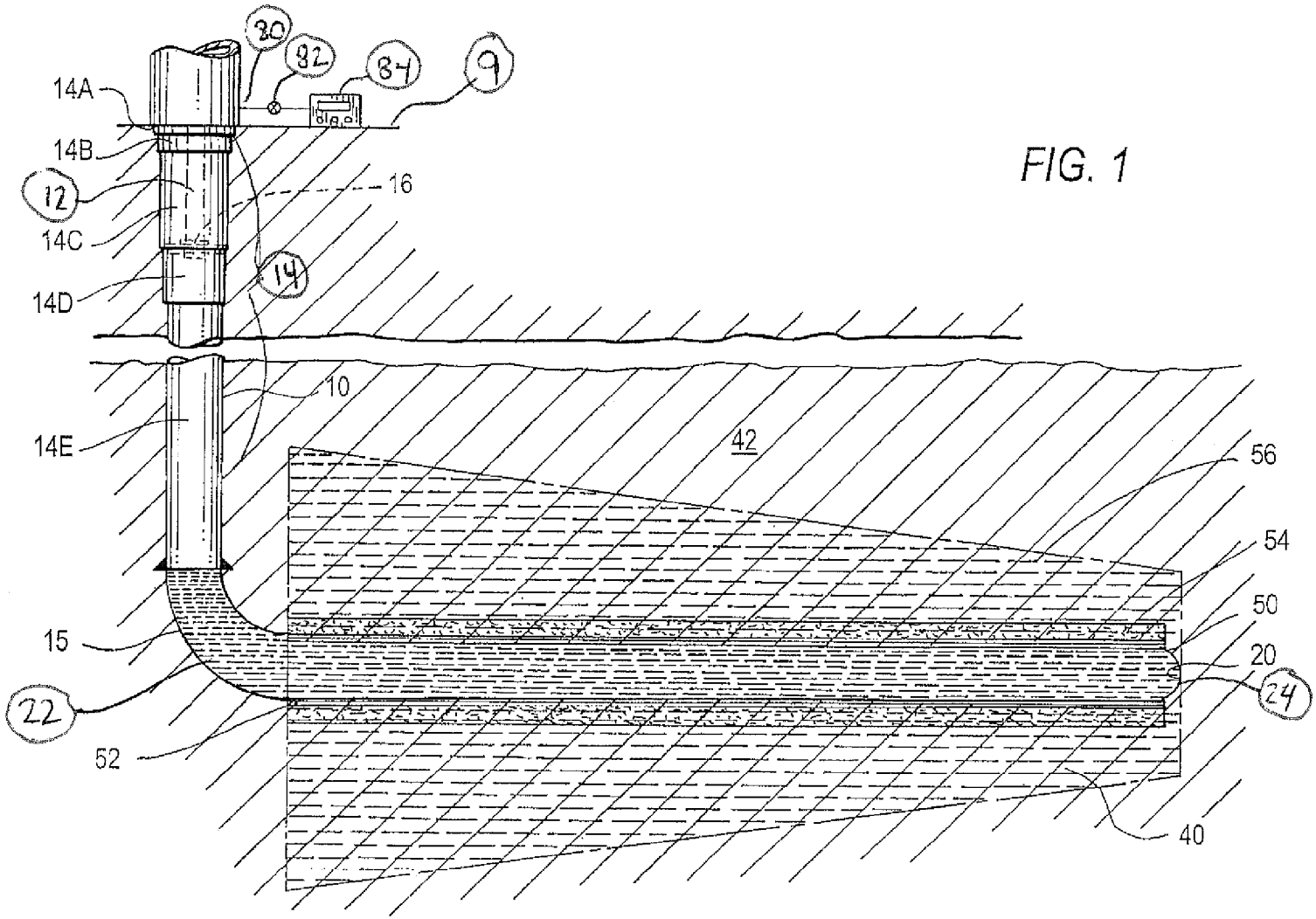

Referring to FIG. 1, a water injection well completion in accordance with the prior art is illustrated that includes a vertical well bore section 10 extending from the earth's surface 9 that includes a series of casing elements, generally identified as 14. As illustrated, the casing 14 includes section 14A extending from the earth's surface having a diameter of about 24 inches. A representative series of concentric casing elements having the indicated diameters are also illustrated as follows: 14B (18⅝"), 14C (13⅝"), 14D (9⅝") and 14E (7"). An injection tubing 12 terminates in supporting element 16. It will be understood by one of ordinary skill in the art that the length of the vertical section 10 can be many thousands of feet.

The horizontal section 20 of the open-hole well bore is also of indeterminate length and is defined by the curved transitional heel portion 22 and the completion end, or toe, 24. Note that the casing 14 terminates at region 15 which defines the beginning of the open-hole portion of the well in the carbonate formation 40.

Also shown in FIG. 1 is sampling point 80 located at the earth's surface that includes control valve 82 and suitable sampling, inspection, testing, recording and alarm apparatus 84. As noted above, the term "open-hole" refers to the fact that well casing 14 terminates at 15 and no well casing pipe is installed in the horizontal section, as it is in the vertical portion of the well bore 10. As will be described in more detail below, the drilling fluid which is very dense to begin with contains undesirable materials, some of which infiltrate even a tight carbonate formation. Solid materials infiltrate beyond the surface of the horizontal bore hole and the liquid components penetrate the tight formation even further while displacing the reservoir fluids, due to the greater hydrostatic pressure of the drilling fluid in the vertical portion of the well. A layer of the solid undesirable materials also builds up in the surface of the bore hole and is referred to as the external filtercake.

Figure 2:
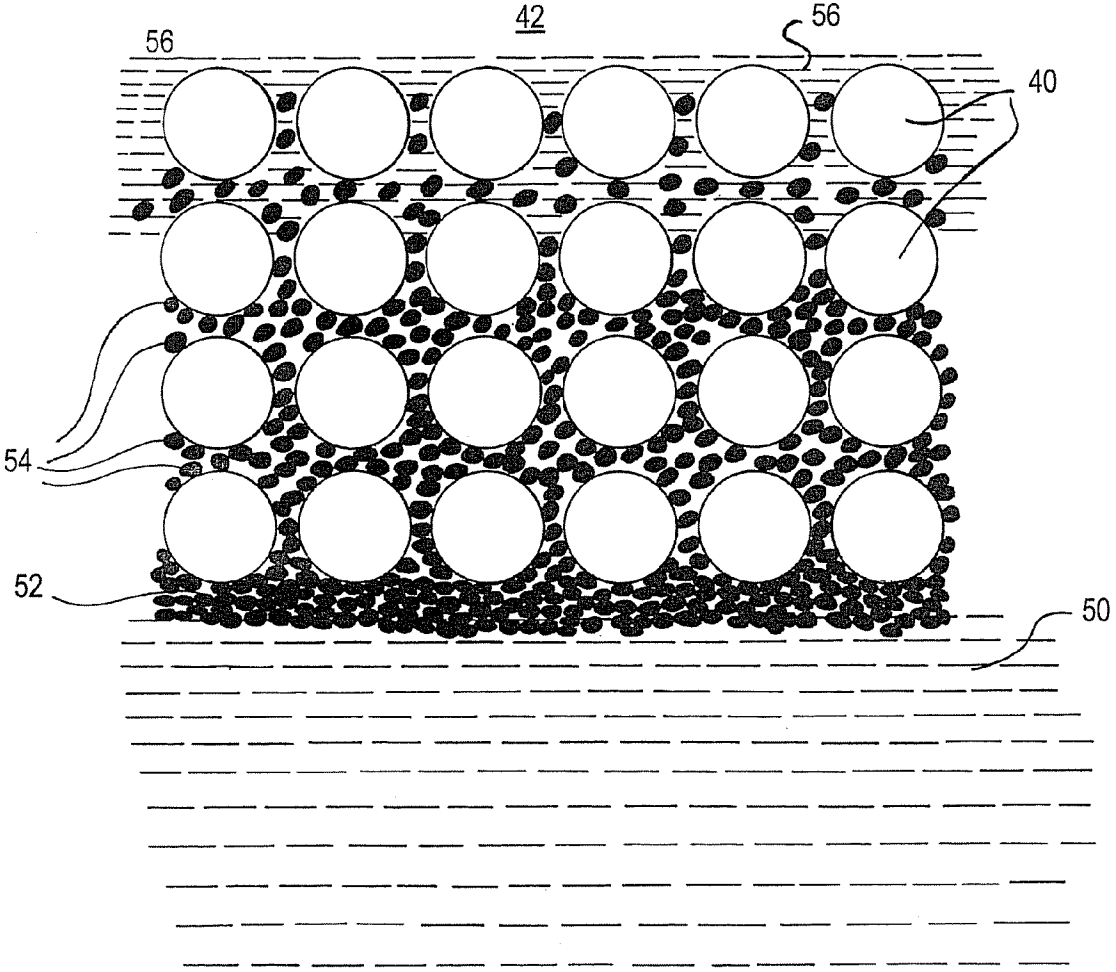
FIG. 2 is a detail of a representative portion of the open-bore well of FIG. 1 schematically illustrating the formation damage.

The problem of mud damage mechanisms is illustrated in the enlarged cross-sectional schematic diagram of FIG. 2 which shows a portion of the tight carbonate formation 40 that is represented by the matrix of circular elements having small pores or passages between them. During the drilling operation, drilling fluid, or mud 50, is introduced under pressure into the upper end of the vertical wellbore 10 for the purposes of lubricating the drill bit (not shown) that is attached to the downhole end of the drill pipe and also, of equal importance, to carry the fragmented formation rock away from the drill bit and up to the surface. Since the drilling fluid 50 is very dense and extends the entire length of the wellbore to the earth's surface, it produces a significant pressure on the open-hole bore in the horizontal drilling phase.

As a result of the over-balanced pressure, an internal filtercake 54 as represented by the small particles in FIG. 2 infiltrates the pores of the reservoir rock 40. In addition, an external filtercake is formed and appears as a uniform dark coating 52 on the walls of the open-hole bore 20. Also as shown in the illustration of FIG. 2, the lighter area 56 extending from the external filtercake 52 represents drilling fluid liquid filtrate which displaces any reservoir fluids 42 which are represented by the darker area.

In accordance with the method of the invention, the reduction of the wellbore fluids overpressure, i.e., by the use of the nitrogen lift that is described in more detail below, will allow the inherent reservoir pressure on the reservoir fluids 42 in the injection zone to cause the reservoir fluids to flow-back into the open-hole bore 20 and thereby flush the filtrate 56, and most, if not all of the internal filtercake 54 and external filtercake 52 from the surrounding reservoir rock.

Figure 3:
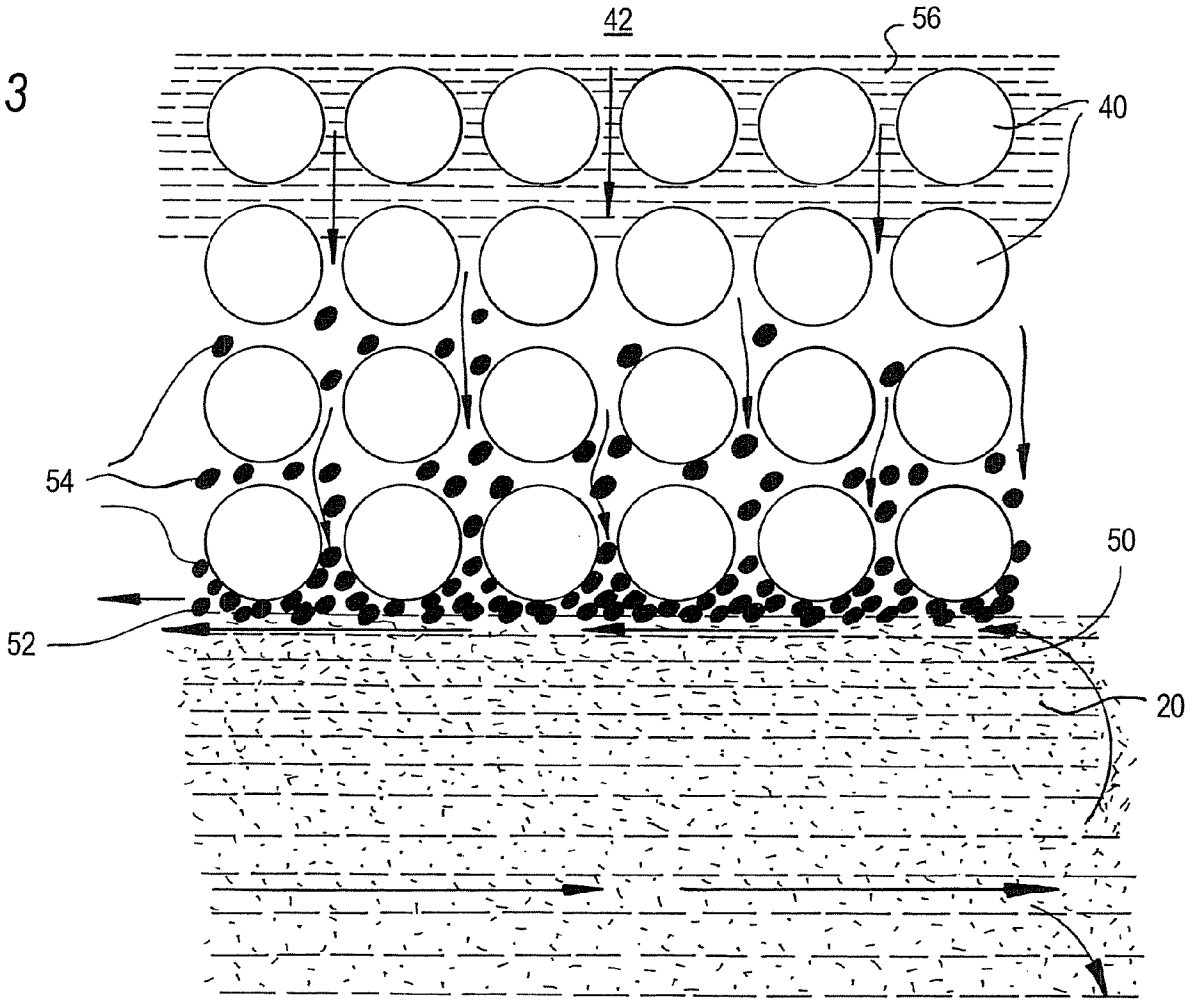
FIG. 3 is a detail similar to FIG. 2 schematically illustrating the effect following application of the method of the invention.

The formation fluids produced during the flow-back stage of the process of the present invention can include brine, hydrocarbon liquids and/or gases, in addition to the drilling fluid filtrate. As schematically illustrated in FIG. 3, following flow-back, substantially all of the external filtercake 52 and most of the internal filtercake 54 and filtrate 56 are flushed from the reservoir rock 40 by the reservoir fluids 42 flowing into the open-hole bore.

As previously noted, nitrogen lifting is an operation that is known and that has been commonly used to enable a well to flow initially or to bring a previously flowing well back into production. The nitrogen is introduced into the vertical section of the well bore at the desired location using coiled tubing. The nitrogen gas functions to "unload" or reduce the hydrostatic pressure upstream of the production zone to thereby under-balance the well so that it will flow naturally as a result of the inherent reservoir pressure.

Utilizing a simple calculation employing the known reservoir pressure at the production zone and along with the weight or density of the completion fluid in the well, the vertical depth of the well and its average diameter, the amount of overbalance can be estimated and the corresponding minimum depth for application of the nitrogen lift can be identified. The nitrogen can be introduced from a pressurized source at the earth's surface at a rate of from 300 to 900 SCF/bbl, the pressure being dependent upon the response achieved in the well during the nitrogen lift operation.

Figure 4:
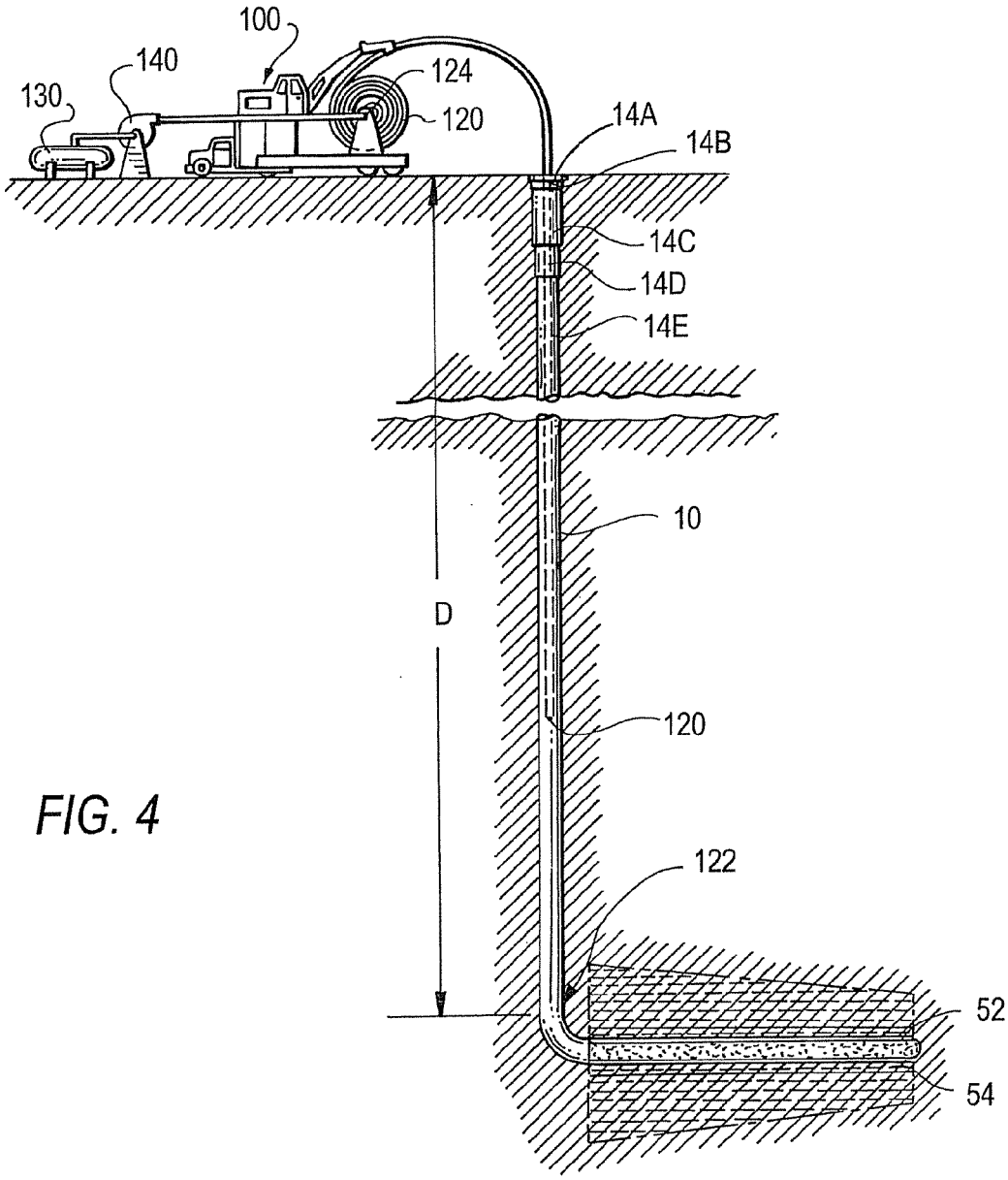
FIG. 4 is a schematic diagram of a completion similar to FIG. 1 illustrating the positioning of apparatus for applying a nitrogen lift to raise the formation fluids to the wellhead.

Referring now to FIG. 4, the well completion of FIG. 1 is shown with the additional apparatus required for performing the nitrogen lift. A specialized vehicle 100 equipped with apparatus for transporting a length of coiled tubing 120 that is sufficient to reach the predetermined desired depth "D" in the vertical portion of the wellbore 10 is disposed adjacent the wellhead 80. The coiled tubing 120 is poured into the well until the end of the tubing 122 reaches the desired predetermined depth "D" below the earth surface.

A source of liquefied nitrogen 130 is also disposed in the proximity of the wellhead and connected to pump 140, which in turn is connected to the inlet end 124 of the coiled tubing which is typically retained on the vehicle 110.

Once the apparatus has been positioned and secured, the liquefied nitrogen is pumped from its container 130 and through the coiled tubing 120 to be discharged into the vertical section 10 of the wellbore. When the liquefied nitrogen has been discharged from the open end 122 of the submerged tubing 120, it rapidly expands to fill the wellbore and rises as an essentially continuous plug or block of gas towards the earth's surface, lifting the well completion fluid/mud out of the wellbore 10. With this reduction in the hydrostatic pressure, the inherent formation pressure of the reservoir is able to displace the filtrate 56 and the reservoir fluids begin their backflow into the horizontal open-hole wellbore 20. In addition to displacing the liquid filtrate 56, the moving fluids also displace the internal filtercake 54 and the external filtercake 52, respectively, from the adjacent formation and the surface of the open-hole bore. These materials will also be carried to the surface where they can be sampled and physically inspected for their content.

In some cases, the inherent reservoir pressure is sufficient to lift the reservoir fluids and any remaining undesired materials and completion fluid/mud to the surface and the injection of the liquefied nitrogen into the vertical wellbore 10 can be discontinued. In the event that the inherent reservoir pressure is not sufficient for this purpose, the nitrogen lift process can be continued while the fluids are inspected at the surface until the desired quality has been observed, after which the nitrogen injection is terminated and the coil tubing withdrawn. Thereafter, the acidizing treatment is initiated and completed as described above.

The method of the invention reduces polymer penetration of the tight carbonate formation 40 during the acid treatment, which is one of the main causes of injectivity loss, especially in tight carbonate formations. Laboratory tests have shown that the injection of a reacted solution of 20 wt % HCl acid and the components of a typical fluid used in the drilling of horizontal water injection wells resulted in a loss of more than 80% of the base core permeability.

EXAMPLES

Application of the method of the invention in three water injection wells produced a significant improvement in their injectivity. A field study was undertaken for the post treatment injection test results for six wells in the same formation in which three of the wells (1, 2, 3) were treated with the industry standard acid treatment and the other three wells (4, 5, 6) were treated using the method of the invention. The results of these comparative tests showed that the wells treated using the flowback method of the invention had a more than 2-fold increase in injectivity at lower injection pressure as compared to those subjected to the same acid treatment, but without the prior flowback stage.

The results of the tests on the six wells are set forth in the following tables, where Table 1 represents the post-acid stimulation treatment injection test without the flowback stage and Table 2 shows the improved results for the series of post-acid stimulation treatment injection tests with the prior flowback stage. In the tables, IWHP is the injection wellhead pressure.

TABLE 1

| | Well No. | | |
|---|---|---|---|
| | Well 1 | Well 2 | Well 3 |
| Injection Rate, bbls/min | 27 | 30 | 20 |
| IWHP, psi | 1500 | 1100 | 1000 |

TABLE 2

| | Well No. | | |
|---|---|---|---|
| | Well-4 | Well-5 | Well-6 |
| Injection Rate, bbls/min | 50.1 | 61.4 | 60 |
| IWHP, psi | 928 | 663 | 591 |

While the process of the invention has been described in detail above and illustrated in the accompanying drawings, modifications and variations will be apparent to those of ordinary skill in the art from this description and the scope of the protection to be accorded the invention is to be determined by the claims which follow.

I claim:

1. A method of preparing for an acid stimulation treatment of an injection zone of an open-hole horizontal water injection wellbore extending from a vertical well in a carbonate reservoir formation containing formation fluids which are under an inherent formation pressure, where the surface of the open-hole wellbore and the adjacent formation are contaminated with undesirable materials that interfere with the acid treatment, the method comprising:

a. following completion of the injection zone of the horizontal wellbore, and without the introduction of new fluids or materials into the well, maintaining well completion fluids present in the vertical and horizontal wellbore under a pressure that is greater than the inherent formation fluid pressure;

b. opening a wellhead valve to reduce the pressure of the completion fluids in the injection zone to a pressure which is less than the inherent formation pressure of the formation fluids proximate the horizontal wellbore, whereby the formation fluids enter the horizontal wellbore and displace the completion fluids;

c. operating the well in a controlled flowback condition to dislodge and carry the undesirable materials into the wellbore by discharging completion fluids and the formation fluids through the wellhead valve at atmospheric pressure;

d. monitoring the produced formation fluids for the presence of the undesirable materials until a predetermined value of undesirable materials is reached;

e. terminating the production of formation fluids at the wellhead; and f. proceeding with the acid stimulation treatment of the horizontal wellbore that has been subjected to the backflow.

2. The method of claim 1 in which the controlled flowback is controlled at the wellhead using the wellhead valve.

3. The method of claim 1 in which the presence of undesirable materials in the formation fluids produced at the wellhead is determined by physical inspection.

4. A method of preparing for an acid stimulation treatment of an injection zone of an open-hole horizontal water injection wellbore extending from a vertical well in a carbonate reservoir formation that contains formation fluids which are under an inherent formation pressure, where the surface of the open-hole wellbore and the adjacent formation are contaminated with undesirable materials that interfere with the acid treatment, the method comprising:

a. following completion of the injection zone of the horizontal wellbore, maintaining the well completion fluids in the vertical and horizontal wellbore under a pressure that is greater than the inherent formation fluid pressure;

b. opening a wellhead valve to the atmosphere to reduce the pressure of the completion fluids in the horizontal wellbore to a pressure which is greater than or equal to the inherent pressure of the formation fluids proximate the horizontal wellbore;

c. further reducing the pressure in the completed horizontal wellbore by vertically displacing a portion of the completion fluid in the vertical wellbore by injecting nitrogen into the vertical well at a predetermined depth at which the injected nitrogen does not penetrate the horizontal wellbore formation, to induce a nitrogen lift of the completion fluids, whereby the formation fluids enter the horizontal wellbore and displace the completion fluids;

d. operating the well in a controlled flowback condition to dislodge and carry the undesirable contamination materials into the wellbore by discharging the completion fluids and the formation fluids through the wellhead valve at atmospheric pressure;

e. monitoring the produced formation fluids for the presence of the undesirable materials until a predetermined value of undesirable materials is reached;

f. terminating the production of the formation fluids at the wellhead; and g. proceeding with the acid stimulation treatment of the horizontal wellbore that has been subjected to the backflow.

5. The method of claim 4 in which the nitrogen is introduced at a predetermined depth in the vertical wellbore.

6. The method of claim 5 which includes the step of determining the depth at which the nitrogen is introduced into the vertical section of the wellbore based upon the inherent formation pressure and the hydrostatic pressure of the drilling fluid filling the wellbore.

7. The method of claim 4 in which the nitrogen is delivered from a storage vessel in liquid form and pumped into the well.

8. The method of claim 4 in which the nitrogen is introduced into the vertical wellbore through coiled tubing.

9. The method of claim 4 in which the presence of undesirable materials in the formation fluids produced at the wellhead is determined by physical inspection.

* * * * *